US005291953A

United States Patent [19]

Mitchhart

[11] Patent Number: 5,291,953

[45] Date of Patent: Mar. 8, 1994

[54] ADJUSTABLE SQUARE POST DRIVER ASSEMBLY

[76] Inventor: Joel W. Mitchhart, 27639 Lake Shore Dr. West, Spring Grove, Ill. 60081

[21] Appl. No.: 8,720

[22] Filed: Jan. 19, 1993

[51] Int. Cl.[5] ..... E02D 7/04

[52] U.S. Cl. ..... 173/90; 254/104; 405/232

[58] Field of Search ..... 173/90, 91, 129, 132; 405/231, 232, 255; 269/234; 254/104

[56] References Cited

U.S. PATENT DOCUMENTS

| | | | |
|---|---|---|---|
| 480,941 | 8/1892 | Stow . | |
| 891,157 | 6/1908 | Freeman . | |
| 1,007,248 | 10/1911 | Smith | 173/90 |
| 1,024,173 | 4/1912 | Betts | 173/91 |
| 1,298,379 | 3/1919 | Osten . | |
| 1,764,223 | 6/1930 | Osten . | |
| 1,847,660 | 3/1932 | Markham | 254/104 |
| 2,166,444 | 7/1939 | Kinninger et al. | 254/104 |
| 2,187,319 | 1/1940 | Greulich | 405/231 |
| 2,330,360 | 9/1943 | Hill . | |
| 3,763,654 | 10/1973 | Matsushita | 405/232 |
| 4,298,075 | 11/1981 | Sweeney . | |
| 4,790,392 | 12/1988 | Clements | 173/90 |
| 5,010,710 | 4/1991 | Gray et al. | 173/90 |

*Primary Examiner*—Scott Smith
*Attorney, Agent, or Firm*—Charles F. Meroni, Jr.

[57] ABSTRACT

A post driver assembly for driving square wood posts comprising a grip retainer plate having a rectangular plate hole centrally located in the plate which is oversized compared to an outside dimension of a square post. A post driver wedge is provided with a flat side for flush engagement with a post side when the post driver wedge is telescoped through the rectangular plate hole. The post driver wedge has a tapered side opposite to the flat side slidingly engageable with an edge of the rectangular plate hole for ensuring snug engagement of the flat side against the post. A screw is threaded through the wedge for attaching the wedge to the post to anchor the wedge to resist vertical slippage of the wedge relative to the wooden post.

26 Claims, 2 Drawing Sheets

FIG. 1
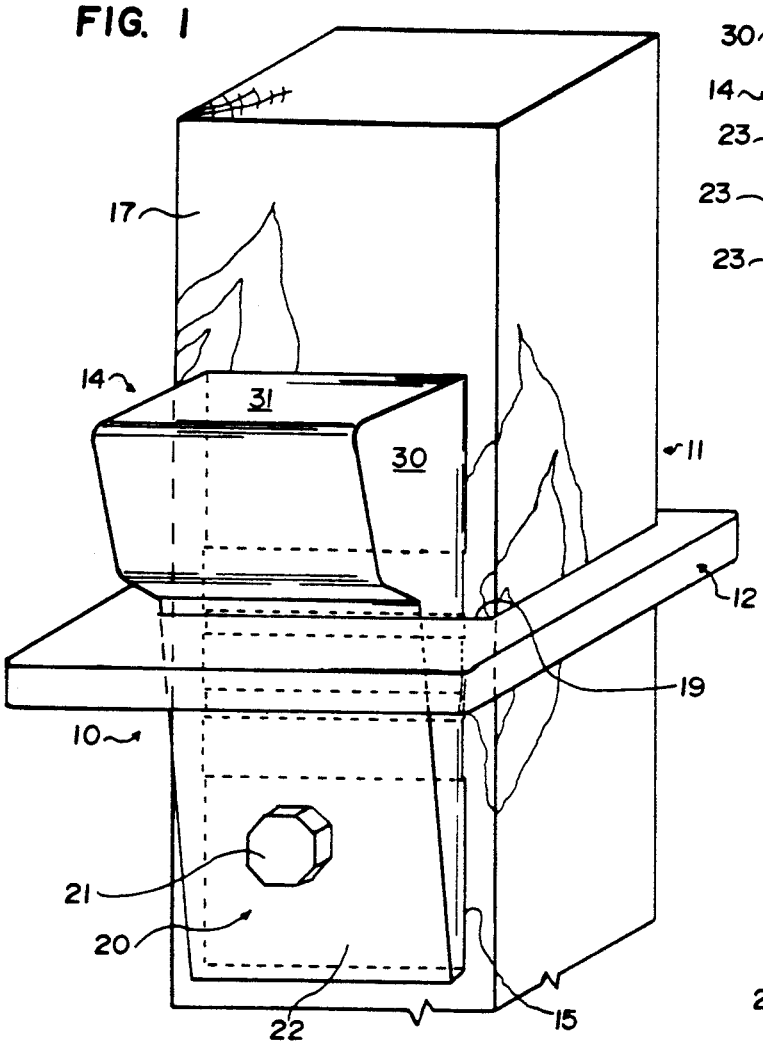
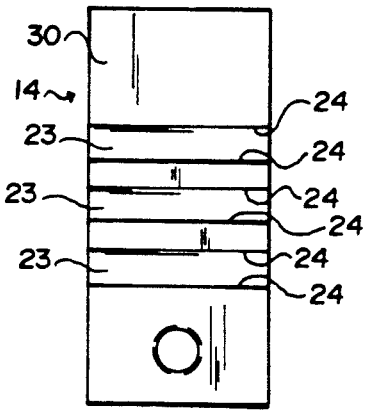
FIG. 3
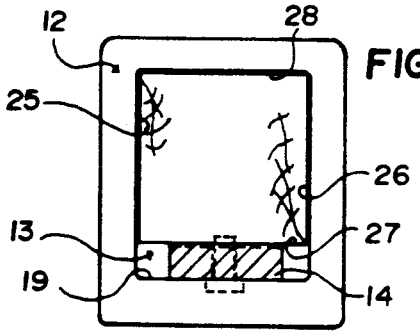
FIG. 4
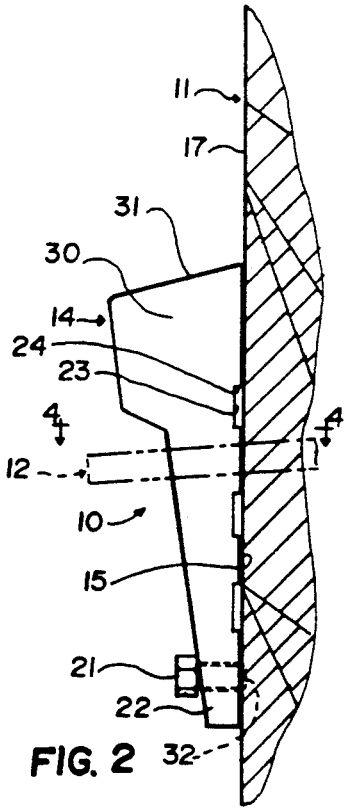
FIG. 2

ADJUSTABLE SQUARE POST DRIVER ASSEMBLY

BACKGROUND OF THE INVENTION

1. Field of the Invention

The present invention relates to post driving means and more particularly to a post driver assembly for driving square wood posts into a ground surface which may be underwater or out of water. While it is contemplated that my post driver assembly is primarily for use with a square wood post, it should be appreciated that the principles of my invention are also applicable to providing a unique way for driving other shaped posts such as round or poly-sided without departing from the scope of my invention.

In the past, various types of post drivers have been in existence but only one has come to my attention where it is asserted that it is particularly adapted for driving parallel sided wooden posts and attention is directed to U.S. Pat. No. 480,941. In this patent, the patentee utilizes a chain "c" mountable upon a post driving device "a" for co-action when mounted on a post "b" so that a person can use a sledge hammer to strike an elongated block of wood "a". It is not seen how this device could be utilized for the purposes of my invention particularly since their is little or no anchorage means for connecting the elongated block of wood "a" to the post "b"other than the chain. If the device "a" were struck by a sledge hammer it would appear that there would be tendancy for it to slide vertically on the post since the chain "c" would not provide an adequate means to hold it in a given position on the post "b". Also it is believed that the chain would tend to come apart should it be subjected to the heavy forces of a sledge hammer when the sledge hammer was caused to strike the elongated block of wood "a".

According to my invention, I have developed a new and improved post driver assembly that is capable of withstanding heavy sledge hammer forces while at the same time being effective to drive square wooden posts into a ground surface whether the surface is underwater or above water.

SUMMARY OF THE INVENTION

According to my invention, I have provided a post driver assembly for driving square wood posts comprising a grip retainer plate having a rectangular hole centrally located in the plate which is oversized compared to an outside dimension of a square post, a post driver wedge having a flat side for flush engagement with a post side when the post driver is telescoped through the rectangular hole, the post driver wedge having a tapered side opposite to the flat side slidingly engageable with an edge of the rectangular hole for ensuring snug engagement of the flat side against the post, and screw means threaded through the wedge for attaching the wedge to the post to resist vertical slippage of the wedge relative to the wooden post.

According to still further features of my invention, I have provided a post driver assembly for driving a post comprising a grip retainer plate having a plate hole centrally located in the plate which is oversized compared to an outside dimension of a square post, a post driver wedge having a wedge face for flush engagement with an outside surface of a post when the post driver is telescoped through the plate hole, the post driver wedge having a tapered side opposite to the wedge face slidingly engageable with an edge of the plate hole for ensuring snug engagement of the wedge face against the post, and screw means threaded through the wedge for attaching the wedge to the post to resist vertical slippage of the wedge relative to the wooden post.

Yet other features of my invention relate to the flat side of the wedge having a vertically spaced transversely extending set of grooves providing vertically spaced transversely extending post gripping edges for biting into a wooden post to resist slippage as a sledge hammer is impacted against the wedge.

Yet other features of my invention relate to the screw means comprising a threaded hex bolt that is threaded through the wedge beneath the plate when the wedge is mounted in the rectangular hole in the plate in readiness for receiving a blow from a sledge hammer when impacted against an upper headed end of the wedge.

Other important features of my invention concern the grip retainer plate having opposite ends that are positioned on opposite sides of the wedge with one end being closer to the post driver wedge when mounted on a post and positioned beneath the end positioned on the other side of the wedge thus causing edges of the rectangular hole to be set in biting engagement with a wooden post when mounted thereon.

BRIEF DESCRIPTION OF THE DRAWINGS

The various features and embodiments of my invention will be better understood from the following detailed description when considered with references to the accompanying drawings, in which:

FIG. 1 is a perspective view of my post driver assembly with the square wood post being shown as a fragmentary component;

FIG. 2 is a vertical section through the post driver assembly shown in FIG. 1 only with a post driver wedge shown in elevation and with certain other components illustrated by dotted lines;

FIG. 3 is a side elevation of my grip retainer plate showing the vertically spaced transversely extending grooves;

FIG. 4 is an enlarged partially cross-sectioned view taken on the line 4—4 looking in the direction indicated by the arrows as seen in FIG. 2;

DESCRIPTION OF THE PREFERRED EMBODIMENT

Figure 7:
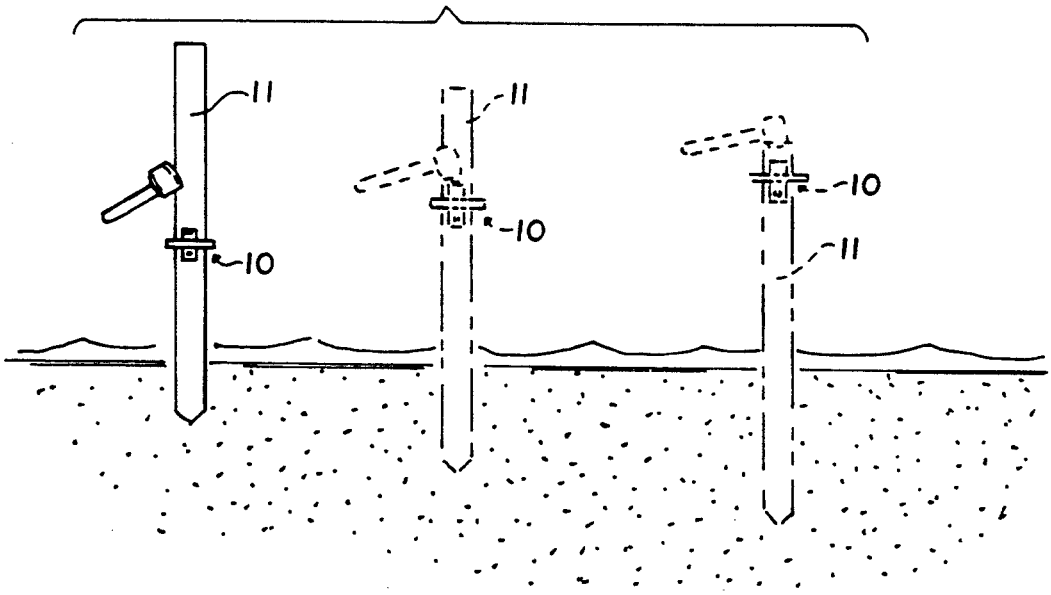
FIG. 7 is a diagrammatic view showing the way in which a sledge hammer can be used to drive a square shaped post into the ground with my post driver assembly mounted thereon and further showing how the position of the post driver assembly can be varied along the length of the post as the post is progressively driven into the ground.

The reference numeral 10 indicates my post driver assembly for driving a square wooden post as indicated at 11. The assembly 10 includes a grip retainer plate 12. The plate 12 is of a flat configuration on all surfaces of the plate and it has a off-centered rectangular hole 13 (FIG. 4). The hole 13 is off-centered ¼ inch relative to opposite ends of the plate 12. The hole 13 is sized so that the perimeter of the post can be snugly engaged in the hole and yet be free to slide back and forth within the hole before a post driver wedge 14. It will be seen that the plate 12 is of rectangular shape. This hole 13 is slightly enlarged at one end relative to the size of a square post (FIG. 4) that is to be driven by my post driver assembly when struck by a sledge hammer as shown in FIG. 7 of my drawings. This plate is preferably made from a high carbon steel or forging. If desired the plate can be heat treated and tempered.

As stated above, another component of my post driver assembly is the post driver wedge 14 which has a flat side 15 for flush engagement with the post 11. More particularly, the wedge 14 has its flat side 15 engaged against a post side or post face 17 of the post when the post driver wedge 14 is telescoped through the rectangular hole 13. The post driver wedge 14 also has a tapered side 18 opposite to the flat side 15 and this tapered side 18 of the post driver wedge 14 is slidingly engageable with an edge 19 of the rectangular hole 13 (FIG. 4) for insuring snug engagement of the flat side 15 against the side 17 (FIGS. 1 and 2) of the post 11 while the post 11 and the wedge 14 are snugly wedged within the plate hole 13 to join the members together. A screw means 20 is provided. This screw means 20 comprises a hex bolt 21 which may be 1½ inches long and it is adapted to be threaded through a lower tapered end 22 of the post driver wedge 14.

Excellent results can be attained using my post driver assembly for driving a square wooden post which may possess 4 inch sides and comprise a 4 inch square. In such event, hole 13 shown in FIG. 4 must be sufficiently oversized compared to the external dimension of the post to receive the tapered wedge 14 in the hole as shown in FIG. 1. It will thus be understood that the post driver assembly, when assembled with the square post 11 will be in tight fitted engagement with a perimeter surface of the post 11 and also will be attached by a screw means to the tip end of the post driver wedge 14 into the post 11 as will be described in further detail hereafter.

My post driver assembly 10 and more particularly the post driver wedge 14 is provided on the flat side 15 of the wedge with vertically spaced transversely extending grooves 23. These grooves 23 (FIG. 3) provide vertically spaced transversely extending post gripping edges 24 for biting into the wooden post 16 to resist slippage as a sledge hammer is impacted against the wedge.

When the components of the post driver assembly 10 are assembled, it will be noted that the square sided post 16 is slightly undersized at one side relative to the rectangular hole 13 to provide a space for the post driver wedge 14 to be received and it is for this reason that I have made the hole 13 of a rectangular shape with side plate edges 25 and 26 are longer with respect to end plate edges 27 and 28 (FIG. 4).

There are certain other features of my invention that should also be carefully considered and in this respect it will be noted that my post driver wedge 14 is also provided with an enlarged wedge head 30. This wedge head 30 has an upper driving wedge face or surface 31 that is disclosed at a 10 degree angle relative to the flat side 15 of my post driver wedge 14. By offsetting the angle of the driving wedge face or surface 31, the surface 31 of the post driver wedge 14 can more easily be driven by a sledge hammer than where the top surface is untapered or at right angles to a vertical axis through the post. It will further be seen that I have located the screw means 20 or bolt 21 vertically beneath the transversely extending grooves 23. When this hex bolt is turned so that its end 32 is screwed into the post 16, this screw end 32 provides a means to tie the wedge 14 to the post 11 so that as the wedge 14 is struck with a sledge hammer, no slippage will occur between the post driver wedge 14 and the post 11. As the post 11 is being driven into the ground, as shown in FIG. 7, the hex bolt 21 can be disengaged from the post 16 and reset at other positions as shown in FIG. 7.

It will further be noted that when my post driver assembly 10 is mounted on the square post 11 that the grip retainer plate 12 is disposed at an inclined angle relative to the post 11 so that edge 28 of the rectangular hole 13 of the plate can dig into the confronting side of the post 11 to further resist slippage of the post driver assembly 10 relative to the post 16.

I have found that excellent results can be attained where the grooves 23 are formed in such a way that they are each approximately ⅜ inch in vertical dimension and have a depth of approximately 0.065 inch.

Other important features of my invention relate to the particular shape of the post driver wedge 14. In this respect, excellent results can be attained where the wedge 14 has a length of approximately 7½ inches and the wedge has a tapered end that is approximately 5 inches in length from a bottom side of the enlarged head end of the wedge 14 to the tip end of the wedge beneath screw hole where the hex bolt 21 is adapted to be threaded.

Figure 5:
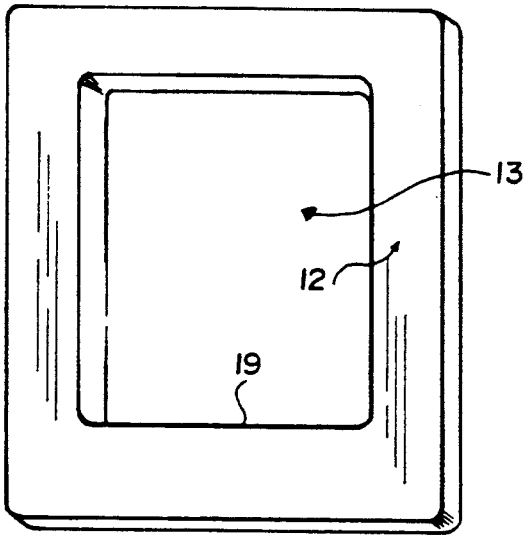
FIG. 5 is a top perspective view of my gripping retainer plate which is a component of my post driver assembly.
Figure 6:
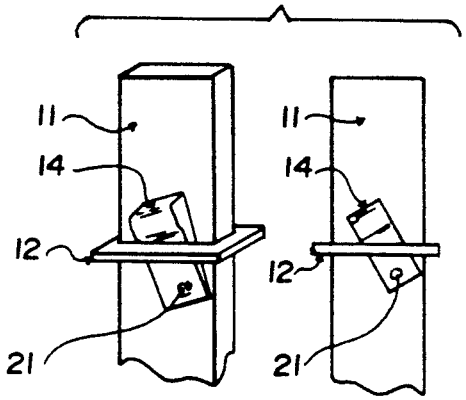
FIG. 6 is a fragmentary sequential view illustrating how a post can be rotated using my post driver assembly by positioning the post driver wedge at an inclination relative to the wooden post so that as the sledge is struck against the wedge can cause the wooden post to rotate from a misaligned position shown in the left-hand view to an aligned position depicted by the right-hand view.

When a square post is to be driven, I have found that in certain types of ground, that there is some tendancy for the post to twist as the sledge is used to drive the post driver wedge 14 downwardly. This twisting action can be corrected by positioning the wedge 14 in a canted position as shown in FIG. 6. The wedge can be canted in one direction or the other depending on which way the correction needs to be made to cause the post to be rotated as it is driven in the ground thereby twisting the post 11 into a more upright position (FIG. 6).

I have found that my post driver assembly has a number of advantages. To this end, it can be used to drive posts into water or wetlands where machinery is not easily brought to such locations. It can further be used for building piers, seawalls, fences and the like. I have further found that with my particular construction, the harder that the sledge is struck against the post driver wedge 14 the tighter that its components including the plate 12 and the wedge 14 will grip the posts. It is also advantageous since the post driver assembly is fully adjustable to drive posts of any length. The post driver assembly is crafted so that it can be easily adjusted to varying post tolerances whether the post is undersized or oversized and still serve to drive the post into the ground. By manufacturing my post driver assembly of the components as discussed above, I have found that it is strong and durable and it can be used to drive posts in the ground in such a way that the posts can be lined up parallel with a fence line before the fence line is attached to the posts.

As described above, this invention provides a number of advantages, some of which have been described above and others of which are inherent in the invention.

I claim:

1. A post driver assembly for driving square wood posts comprising a grip retainer plate having a rectangular plate hole centrally located in the plate which is oversized compared to an outside dimension of a square wood post, a post driver wedge having a flat side for flush engagement with a wood post side when said post driver wedge is telescoped through said rectangular plate hole, said post drivwer wedge having a tapered side opposite to said flat side slidingly engageable with an edge of said rectangular plate hole for ensuring snug engagement of said flat side against a square wood post, said wedge and said oversized plate hole providing means to tip the plate with one end of the plate adjacent to the wedge being lower than an opposite end of the plate when mounted on a square wooden post to snugly secure the plate to a wooden post with opposed edges of the oversized plate hole being bitingly engaged into opposite flat sides of a square wooden post, and screw means threaded through said wedge for attaching said wedge to a square wood post to resist vertical slippage of said wedge relative to a square wooden post.

2. The post driver assembly of claim 1 wherein said flat side of said wedge has vertically spaced transversely extending grooves providing vertically spaced transversely extending post gripping edges for biting into a wooden post to resist slippage as a sledge hammer is impacted against the wedge, the vertically space transversely extending post gripping edges align within a vertical plane through said flat side of said wedge with said grooves sunken in said flat side of the wedge, said wedge and said gripping edges being rotatable on said screw means to assist in causing a square wooden post to be returned to an upright position when the wedge is hammered while lying in an inclined position relative to the post.

3. The post driver assembly of claim 2 wherein said post gripping edges include at least six sharp corners for engagement with a wooden post to resist sliding movement.

4. The post driver assembly of claim 2 wherein said screw means is positioned beneath al of said vertically spaced transversely extending post gripping edges.

5. The post driver assembly of claim 2 wherein said grooves are each generally U-shaped and have a vertical height of the order of ⅛ inch.

6. The post driver assembly of claim 2 further characterized by each of said grooves being generally U-shaped and having a depth of the order of 1/16 inch.

7. The post driver assembly of claim 1 wherein said screw means is threaded through said wedge beneath said plate.

8. The post driver assembly of claim 1 wherein said post driver wedge has an enlarged head at an upper end, said head having an inclined upper wedge driving surface.

9. The post driver assembly of claim 8 wherein said upper wedge driving surface is positioned at approximately an 80 degree angle relative to said flat side of said post driver wedge.

10. The post driver assembly of claim 1 wherein said grip retainer plate is flat on all exterior surfaces of said plate.

11. The post driver assembly of claim 1 wherein said grip retainer plate has opposite ends positioned on opposite sides of said wedge with one end being closer to said post driver wedge when mounted on a post and positioned beneath the end positioned on the other side of said wedge thus causing edges of said rectangular hole to be set in biting engagement with a wooden post when mounted thereon.

12. The post driver assembly of claim 1 wherein said tapered side has a 5 degree angle of inclination relative to said flat side of said post driver wedge.

13. A post driver assembly for driving a post comprising a grip retainer plate having a rectangular plate hole centrally located in the plate which is oversized compared to an outside dimension of a square post, a post driver wedge having a wedge face for flush engagement with an outside surface of a post when said post driver wedge is telescoped through said plate hole, said post driver wedge having a tapered side opposite to said wedge face slidingly engageable with an edge of said plate hole for ensuring snug engagement of said wedge face against said post, and screw means threaded through said wedge for attaching said wedge to said post to resist vertical slippage of said wedge relative to a wooden post, a wedge face of said wedge having vertically spaced transversely extending grooves providing vertically spaced transversely extending post gripping edges for biting into a wooden post to resist slippage as a sledge hammer is impacted against the wedge, said screw means is threaded through said wedge beneath said plate, the wedge having a smaller width than the rectangular plate hole thus enabling the wedge to be rotated on said screw means while lying in said rectangular plate hole to assist in restoring a post being driven into an upright position, said post driver wedge has an enlarged head at an upper end, said head having an inclined upper wedge driving surface.

14. The post driver assembly of claim 13 wherein said upper wedge driving surface is positioned at approximately an 80 degree angle relative to a vertical axis through a post to be driven.

15. A post driver assembly for driving a post comprising a grip retainer plate having a plate hole centrally located in the plate which is oversized compared to an outside dimension of a square post, a post driver wedge having a wedge face for flush engagement with an outside surface of a post when said post driver wedge is telescoped through said plate hole, said post driver wedge having a tapered side opposite to said wedge face slidingly engageable with an edge of said plate hole for ensuring snug engagement of said wedge face against said face, and screw means threaded through said wedge for attaching said wedge to said post to resist vertical slippage of said wedge relative to a square post.

16. The post driver assembly of claim 15 wherein said wedge face of said wedge has vertically spaced transversely extending sunken grooves sunk into the wedge face of the wedge providing vertically spaced transversely extending post gripping edges for biting into a wooden post to resist slippage as a sledge hammer is impacted against the wedge, the edges lying in a vertical plane common with the wedge face where the grooves are sunk, the wedge being rotatable about said screw means relative to said plate to assist in moving a misaligned wooden post into an upright position when the wedge is hammered.

17. The post driver assembly of claim 15 wherein said screw means is threaded through said wedge said plate.

18. A post driver assembly for driving square wood posts comprising a grip retainer plate having a rectangular hole centrally located in the plate which is oversized compared to an outside dimension of a square post, a post driver wedge having a flat side for flush engagement with a post side when said post driver wedge is telescoped through said rectangular hole, said post driver wedge having a tapered side opposite tos aid flat side slidingly engageable with an edge of said rectangular hole for ensuring snug engagement of said flat side against a square wooden post to resist vertical slippage of said wedge relative to a square wooden post, said grip retainer plate has opposite ends positioned on opposite sides of said wedge with one end being closer to said post driver wedge when mounted on a square wooden post and positioned beneath the end positioned on the other side of said wedge thus causing edges of said rectangular hole to be set in biting engagement with a square wooden post when mounted thereon.

19. The post driver assembly of claim 18 wherein said flat side of said wedge has sunken vertically spaced transversely extending grooves providing vertically spaced transversely extending post gripping edges lying in a vertical plane of the flat side of the wedge for biting into a wooden post to resist slippage as a sledge hammer is impacted against the wedge, the sunken vertically spaced transversely extending grooves enabling the wedge to rotate about said screw means to enable the post driver when in a slanted position to straighten a square wood post when being driven into ground.

20. The post driver assembly of claim 19 wherein said post gripping edges include at least six sharp corners for engagement with a wooden post to resist sliding movement.

21. The post driver assembly of claim 19 wherein said screw means is positioned beneath all of said vertically spaced transversely extending post gripping edges for ease of rotation of the wedge about said screw means.

22. The post driver assembly of claim 19 wherein said grooves are each generally U-shaped and have a vertical height of the order of ⅛ inch.

23. The post driver assembly of claim 19 further characterized by each of said grooves being generally U-shaped and having a depth of the order of 1/16 inch.

24. The post driver assembly of claim 19 wherein said screw means is threaded through said wedge beneath said plate.

25. The post driver assembly of claim 18 wherein said grip retainer plate is flat on all exterior surfaces of said plate.

26. The post driver assembly of claim 18 wherein said wedge face of said wedge has vertically spaced transversely extending sunken grooves sunk into the wedge face of the wedge providing vertically spaced transversely extending post gripping edges for biting into a wooden post to resist slippage as a sledge hammer is impacted against the wedge, the edges lying in a vertical plane common with the wedge face where the grooves are sunk.

* * * * *